US009327545B2

(12) United States Patent
Tarlow et al.

(10) Patent No.: US 9,327,545 B2
(45) Date of Patent: May 3, 2016

(54) HANDHELD PRECISE LIQUID MARKER

(71) Applicant: Golf Rite Products, LLC, Santa Barbara, CA (US)

(72) Inventors: Kenneth M Tarlow, Santa Barbara, CA (US); Frank Francavilla, Wantage, NJ (US)

(73) Assignee: Golf Rite Products, LLC, Santa Barbara, CA (US)

( * ) Notice: Subject to any disclaimer, the term of this patent is extended or adjusted under 35 U.S.C. 154(b) by 266 days.

(21) Appl. No.: 14/058,212

(22) Filed: Oct. 18, 2013

(65) Prior Publication Data

US 2014/0119807 A1 May 1, 2014

Related U.S. Application Data

(60) Provisional application No. 61/718,881, filed on Oct. 26, 2012.

(51) Int. Cl.
*B43K 29/00* (2006.01)
*A63B 57/00* (2015.01)
(Continued)

(52) U.S. Cl.
CPC ..... *B43K 29/005* (2013.01); *A63B 57/00* (2013.01); *B43K 23/008* (2013.01); *B43K 23/12* (2013.01); *B43K 27/08* (2013.01); *A63B 45/02* (2013.01)

(58) Field of Classification Search
CPC ..... B43K 27/00; B43K 27/08; B43K 3/04; B43K 23/00; B43K 23/008; B43K 23/06; B43K 31/00
USPC ..... 401/17, 23, 99, 103, 194, 196, 202, 401/206; D19/117, 155, 199
See application file for complete search history.

(56) References Cited

U.S. PATENT DOCUMENTS 3,003,183 A 10/1961 Rosenthal
3,019,762 A 2/1962 Haufz
(Continued)

FOREIGN PATENT DOCUMENTS

AU 5584186 9/1986
AU 200141985 9/2001
(Continued)

OTHER PUBLICATIONS

Noel Runyan, Jim Tobias, InkaVote Plus Voting System Access Review, Access Report, Jan. 2, 2008 https://www.sos.ca.gov/voting-systems/oversight/ttbr/inkavote-access-report.pdf.
(Continued)

*Primary Examiner* — David Walczak
*Assistant Examiner* — Bradley Oliver
(74) *Attorney, Agent, or Firm* — Hankin Patent Law, APC; Jimmy Sauz; Anooj Patel

(57) ABSTRACT

A handheld precise liquid marker. The handheld precise liquid marker preferably creates a substantially perfect dot when marking one or more surfaces and is preferably used for multiple applications such as marking a dimple of a golf ball surface and/or providing a proper amount of dosage for medicinal applications. The handheld precise liquid marker may also comprise a liquid delivery system for dispensing a precise amount of ink or liquid onto various surfaces, a projecting/retracting mechanism, and an audible and/or tactile physical feedback mechanism. The projecting/retracting mechanism may controllably retract or protrude a nib into and out of the housing, and the audible/physical feedback mechanism may provide either a physical and/or audible click once a desired amount of ink or liquid transfers onto the surface.

13 Claims, 11 Drawing Sheets

(51) Int. Cl.

| | |
|---|---|
| ***B43K 27/08*** | (2006.01) |
| ***B43K 23/008*** | (2006.01) |
| ***B43K 23/12*** | (2006.01) |
| *A63B 45/02* | (2006.01) |

(56) References Cited

U.S. PATENT DOCUMENTS

| | | | | |
|---|---|---|---|---|
| 4,685,820 | A | 8/1987 | Kremer | |
| 4,792,252 | A | 12/1988 | Kremer | |
| 5,582,598 | A | 12/1996 | Chanoch | |
| 5,971,648 | A | 10/1999 | Koreska | |
| D438,903 | S * | 3/2001 | Rosenbaum | D19/199 |
| 6,361,234 | B1 | 3/2002 | Rukan | |
| 6,379,271 | B1 | 4/2002 | Arnke | |
| D483,408 | S | 12/2003 | Smiskol | |
| 6,932,794 | B2 | 8/2005 | Gambattista | |
| 6,986,760 | B2 | 1/2006 | Giambattista | |
| 7,210,869 | B2 * | 5/2007 | Kageyama | B43K 23/12 401/17 |
| 7,556,615 | B2 | 7/2009 | Pettis | |
| 7,713,229 | B2 | 5/2010 | Veit | |
| 7,927,281 | B2 | 4/2011 | Wheeler | |
| 7,959,368 | B2 * | 6/2011 | Sheu | B43K 23/128 401/103 |
| 8,092,108 | B2 | 1/2012 | Bainbridge | |
| 2004/0162524 | A1 | 8/2004 | Schiff | |
| 2008/0015511 | A1 | 1/2008 | Veasey | |
| 2009/0069752 | A1 | 3/2009 | Raj | |
| 2009/0069753 | A1 | 3/2009 | Ruan | |
| 2009/0275915 | A1 | 11/2009 | Harms | |
| 2010/0170409 | A1 | 7/2010 | Chan | |
| 2010/0186739 | A1 | 7/2010 | Kronestedt | |
| 2010/0239357 | A1 | 9/2010 | Bolton | |
| 2010/0296858 | A1 | 11/2010 | Richards | |
| 2011/0071492 | A1 | 3/2011 | Horvath | |
| 2011/0092917 | A1 | 4/2011 | Wei | |
| 2011/0118667 | A1 | 5/2011 | Zaiken | |
| 2011/0158738 | A1 | 6/2011 | Bainbridge | |
| 2011/0257604 | A1 | 10/2011 | Banik | |
| 2013/0243514 | A1 | 9/2013 | Ballot | |

FOREIGN PATENT DOCUMENTS

| | | |
|---|---|---|
| BR | 0109111 | 6/2003 |
| CA | 2402333 | 9/2001 |
| CA | 2867154 | 9/2013 |
| CN | 1225369 | 7/2003 |
| CN | 1427681 | 7/2003 |
| DE | 3681317 | 10/1991 |
| DE | 60140861 | 2/2010 |
| EP | 0197281 | 10/1986 |
| EP | 1261261 | 12/2002 |
| JP | 2003525775 | 9/2003 |
| JP | 4131794 | 8/2008 |
| MX | PA02008713 | 4/2003 |
| TW | 548202 | 8/2003 |
| WO | 8605144 | 9/1986 |
| WO | 0165970 | 12/2001 |
| WO | 2013138664 | 9/2013 |

OTHER PUBLICATIONS

MILD816, Inkavote Demonstration, Demonstration Video, Nov. 4, 2008 http://www.youtube.com/watch?v=1HH4bZtWqUE.

Inkavote Procedures, Use Manual, Nov. 1, 2010 http://www.sos.ca.gov/voting-systems/vendors/use-procedures/los-angeles-use-procedures-complete.pdf.

The International Searching Authority, PCT International Search Report, Jan. 12, 2015, 11 pages.

* cited by examiner

HANDHELD PRECISE LIQUID MARKER

CROSS-REFERENCE TO RELATED APPLICATIONS

This application takes priority from U.S. Provisional Patent Application No. 61/718,881, filed on Oct. 26, 2012, titled "Handheld Precise Liquid Marker", by inventor Kenneth Martin Tarlow, the contents of which are expressly incorporated herein by this reference as though set forth in their entirety, and to which priority is claimed.

FIELD OF INVENTION

This present invention relates to handheld liquid marker devices for marking one or more surfaces. More particularly, the invention relates to a pen-shaped device with a delivery system for providing a precise amount of liquid, such as ink or medicinal liquid, when marking or dosing a surface while, at the same time, providing tactile or audible feedback.

BACKGROUND

For centuries, people have used various marking utensils when applying liquid such as ink onto a surface. Examples of such marking utensils generally include reed pens, quill pens, and dip pens where the nib of the pen in dipped into ink and applied onto the desired surface. Modern writing utensils such as ballpoint, rollerball, and fountain pens would typically require an ink reservoir connected to the nib. The reservoir typically contains the ink or liquid, which would transfer through the nib, and the liquid would be applied onto a surface. Unfortunately, markings with these types of writing utensils may often be messy for certain marking applications (e.g., a single vertical press marking for a dot), as these markings tend to create and/or result in messy blotches.

Additionally, most marking utensils or ink applicators fail to provide any audible or physical feedback to notify the user that a sufficient application of liquid is applied. This is especially helpful to prevent unnecessary blotching of the liquid onto the desired surface. Thus, without any feedback or notification mechanism, the user may apply more ink than necessary, thereby also contributing to an undesirable application of the liquid.

There are some references that disclose marking utensils that are configured to provide a precise amount of liquid onto a surface. For example, U.S. Published Patent Application No. 2004/0162524, filed by Schiff, discloses a pen style liquid dispenser. The inside mechanism of the Schiff liquid dispenser consists of a spring system and a liquid dispenser, which may be used for medicinal liquids. Additionally, U.S. Published Patent Application No. 2010/0170409, filed by Chan discloses a "stamp pen" or dauber that may have a spring behind the ink reservoir or behind the nib. The Chan Nib is pushed inward when the nib is pressed against the surface to be marked. However, these references fail to incorporate a precise liquid delivery system with an audible or tactile response feedback to notify the user that a sufficient application of liquid is applied.

Therefore, there is a need for a device with a liquid delivery mechanism that will release a precise amount of ink or liquid onto one or more surfaces for certain types of markings such as a vertical press marking. Preferably, the device may be used for various applications such as marking the surface of a golf ball or providing a proper amount of dosage for medicinal applications. The liquid delivery mechanism of the device also preferably provides some audible and/or physical feedback to the user when sufficient pressure has activated the internal mechanism.

SUMMARY OF THE INVENTION

To minimize the limitations in the prior art, and to minimize other limitations that will become apparent upon reading and understanding the present specification, the following discloses a handheld precise liquid marker with a delivery system that provides a precise amount of liquid, which may be ink or medicinal liquids, when marking one or more surfaces. The liquid delivery mechanism preferably includes some audible and/or physical feedback and is preferably used in various applications such as marking a golf ball or medicinal applications.

One embodiment of the new device is a handheld precise liquid marker, comprising: a front housing; a first nib; a piston; and a spring; wherein the front housing comprises a first reservoir; wherein the first reservoir is configured to store a liquid; wherein the front housing has a forward end and a rear end; wherein the first nib is positioned at the forward end of the front housing and is in fluid communication with the first reservoir; wherein the piston is positioned behind the rear end of the front housing; and wherein the spring is positioned inside the piston, such that the piston biases towards the rear end of the front housing. The handheld precise liquid marker may further comprise: a main housing; wherein the main housing may have a central opening; and wherein the front housing may be substantially enclosed within the main housing, such that, a portion of the first nib may protrude through the central opening of the main housing, and, such that a portion of the first nib may controllably retract through the central opening of the main housing upon compression of the first nib onto one or more surfaces. The front housing may comprise a shoulder located at an exterior of the front housing; wherein the main housing may comprise an inner flange located inside an interior of the main housing; and wherein the shoulder may be configured to restrict the projection of the portion of the nib through the central opening of the main housing when the shoulder of the front housing contacts the inner flange of the main housing. The piston may comprise: a first cylinder, a second cylinder, one or more first tabs, and one or more second tabs; wherein the one or more first tabs may be located at an outer surface of the first cylinder; wherein the one or more second tabs may be located at an inner surface of the second cylinder; wherein the spring may be positioned in-between the first cylinder and the second cylinder, such that a portion of the second cylinder may overlap a portion of the first cylinder; and wherein the one or more first tabs and one or more second tabs may produce an audible click upon the compression of the first nib, such that the compression of the first nib may cause the one or more first tabs to contact the one or more second tabs. The one or more first tabs and one or more second tabs may produce a tactile response upon the compression of the first nib. The first nib may be substantially curved, such that the first nib is configured to matingly engage with a single dimple of a golf ball. The handheld precise liquid marker of may further comprise: a rear housing; and a second nib; wherein the rear housing may comprise a second reservoir; wherein the second reservoir may be configured to store the liquid; wherein the second reservoir may have a forward end and a rear end; and wherein the second nib may be positioned at the rear end of the second reservoir and may be in fluid communication with the second reservoir. The handheld precise liquid marker may further comprise a plug; wherein the plug may removeably attach to the forward end of the rear housing; and wherein the piston may be configured to removeably attach to the plug. The second nib may have a substantially sharp point, such that the second nib is configured to produce one or more thin strokes on the one or more surfaces when the second nib is applied to the one or more surfaces. The main housing may comprise a grip; and wherein the grip may be substantially curved and may comprise a plurality of dimples.

Another embodiment of the new device is a handheld precise liquid marker, comprising: a front housing; a first nib; a piston; a spring; and a main housing; wherein the front housing comprises a first reservoir; wherein the first reservoir is configured to store a liquid; wherein the front housing has a forward end and a rear end; wherein the first nib is positioned at the forward end of the front housing and is in fluid communication with the first reservoir; wherein the piston is positioned behind the rear end of the front housing; wherein the spring is positioned inside the piston, such that the piston biases towards the rear end of the front housing; wherein the main housing has a central opening; wherein the front housing is substantially enclosed within the main housing, such that, a portion of the first nib protrudes through the central opening of the main housing, and, such that a portion of the first nib controllably retracts through the central opening of the main housing upon compression of the first nib onto one or more surfaces; and wherein the first nib is substantially curved, such that the first nib is configured to matingly engage with a single dimple of a golf ball, and when the first nib contacts the dimple of the golf ball, a substantially round ink dot is created on the dimple of the golf ball; wherein the piston comprises: a first cylinder, a second cylinder, one or more first tabs, and one or more second tabs; wherein the one or more first tabs are located at an outer surface of the first cylinder; wherein the one or more second tabs are located at an inner surface of the second cylinder; wherein the spring is positioned in-between the first cylinder and the second cylinder, such that a portion of the second cylinder overlaps a portion of the first cylinder; and wherein the one or more first tabs and one or more second tabs produces an audible click upon the compression of the first nib, such that the compression of the first nib causes the one or more first tabs to contact the one or more second tabs. The front housing may further comprise a shoulder; wherein the shoulder of the front housing may be located at an exterior of the front housing; wherein the main housing may comprise an inner flange located inside an interior of the main housing; and wherein the shoulder may be configured to restrict the projection of the portion of the nib through the central opening of the main housing when the shoulder of the front housing contacts the inner flange of the main housing. The one or more first tabs and one or more second tabs may produce a tactile response upon the compression of the first nib. The handheld precise liquid marker may further comprise: a rear housing; and a second nib; wherein the rear housing may comprise a second reservoir; wherein the second reservoir may be configured to store the liquid; wherein the second reservoir may have a forward end and a rear end; and wherein the second nib may be positioned at the rear end of the second reservoir and may be in fluid communication with the second reservoir. The handheld precise liquid marker may further comprise a plug; wherein the plug may removeably attach to the forward end of the rear housing; and wherein the piston may be configured to removeably attach to the plug. The second nib may have a substantially sharp point, such that the second nib may be configured to create one or more thin strokes on the one or more surfaces when the second nib is applied to the one or more surfaces. The main housing may comprise a grip; and wherein the grip may be substantially curved and may comprise a plurality of dimples, such that the grip may resemble a surface of the golf ball. The first nib may be constructed of a porous polymer material. The second nib may be constructed of a porous polymer material.

Another embodiment of the new device is a handheld precise liquid marker, comprising: a front housing; a first nib; a piston; a spring; a main housing; a rear housing; a second nib; and a plug; wherein the front housing comprises a first reservoir; wherein the first reservoir is configured to store a liquid; wherein the front housing has a forward end and a rear end; wherein the first nib is positioned at the forward end of the front housing and is in fluid communication with the first reservoir; wherein the piston is positioned behind the rear end of the front housing; wherein the spring is positioned inside the piston, such that the piston biases towards the rear end of the front housing; wherein the main housing comprises a central opening; wherein the front housing is substantially enclosed within the main housing, such that, a portion of the first nib protrudes through the central opening of the main housing, and, such that a portion of the first nib controllably retracts through the central opening of the main housing upon compression of the first nib onto one or more surfaces; wherein the front housing further comprises a shoulder; wherein the shoulder of the front housing is located at an exterior of the front housing; wherein the main housing comprises an inner flange located inside an interior of the main housing; wherein the shoulder is configured to restrict the projection of the portion of the nib through the central opening of the main housing when the shoulder of the front housing contacts the inner flange of the main housing; wherein the piston comprises: a first cylinder, a second cylinder, one or more first tabs, and one or more second tabs; wherein the one or more first tabs are located at an outer surface of the first cylinder; wherein the one or more second tabs are located at an inner surface of the second cylinder; wherein the spring is positioned in-between the first cylinder and the second cylinder, such that a portion of the second cylinder overlaps a portion of the first cylinder; wherein the one or more first tabs and one or more second tabs produces an audible click upon the compression of the first nib, such that the compression of the first nib causes the one or more first tabs to contact the one or more second tabs; wherein the one or more first tabs and one or more second tabs produces a tactile response upon the compression of the first nib; wherein the rear housing comprises a second reservoir; wherein the second reservoir is configured to store the liquid; wherein the second reservoir has a forward end and a rear end; wherein the second nib is positioned at the rear end of the second reservoir and is in fluid communication with the second reservoir; wherein the plug removeably attaches to the forward end of the rear housing; wherein the piston is configured to removeably attach to the plug; wherein the second nib has a substantially sharp point, such that the second nib is configured to create one or more thin strokes on the one or more surfaces when the second nib is applied to the one or more surfaces; and wherein the first nib is constructed of a porous polymer material.

It is an object of the new device to provide a handheld precise liquid marker for multiple surfaces such as a golf ball surface.

It is an object of the new device to provide a handheld precise liquid marker used for various applications such as marking the surface of a golf ball and/or applying the proper amount of dosage of topical medicine for medicinal purposes.

It is an object of the new device to provide a handheld precise liquid marker for a single vertical press marking that is in the shape of a pen.

It is an object of the new device to provide a handheld precise liquid marker for a single vertical press marking that is in the shape of a pen.

It is an object of the new device to provide a handheld precise liquid marker with a substantially pointed nib for writing thin strokes.

It is an object of the new device to provide a handheld precise liquid marker with a nib that controllably retracts inside the housing of the device upon application of the nib onto one or more surfaces.

It is an object of the new device to provide a handheld precise liquid marker with a housing that is ergonomic and is preferably shaped with dimples to simulate as a golf ball surface.

It is an object of the new device to provide a handheld precise liquid marker with a liquid delivery system that releases a sufficient amount of liquid upon application onto a surface without producing any blotches or mess.

It is an object of the new device to provide a handheld precise liquid marker that produces a physical and/or audible click once a desired amount of liquid transfers onto one or more surfaces.

It is an object of the new device to overcome the limitations of the prior art.

Additional embodiments of the invention will be understood from the detailed description of the invention.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE INVENTION

Figure 1:
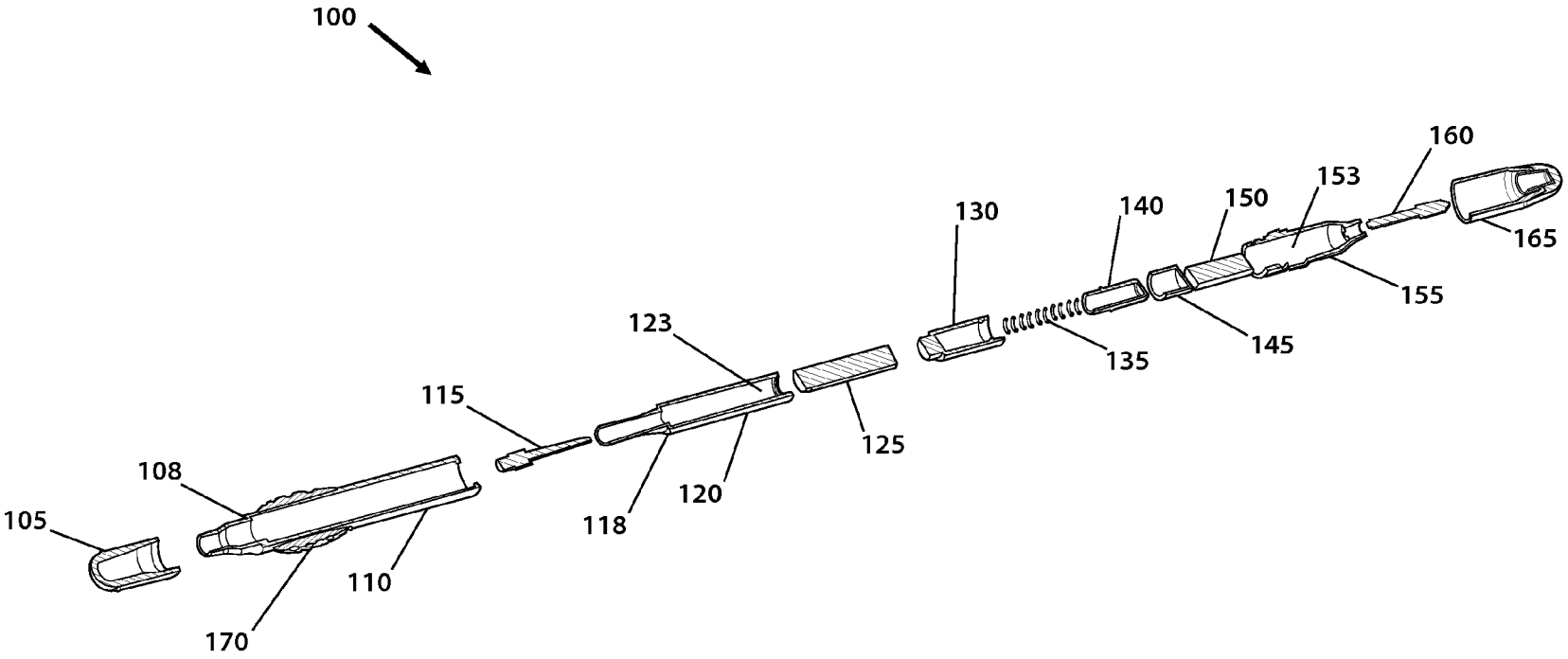
FIG. 1 is an illustration of a cross-sectional, exploded perspective view of one embodiment of the handheld precise liquid marker.

In the following detailed description of various embodiments of the invention, numerous specific details are set forth in order to provide a thorough understanding of various aspects of one or more embodiments of the invention. However, one or more embodiments of the invention may be practiced without some or all of these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the screen shot figures, and the detailed descriptions thereof, are to be regarded as illustrative in nature and not restrictive. Also, the reference or non-reference to a particular embodiment of the invention shall not be interpreted to limit the scope of the invention.

In the following description, certain terminology is used to describe certain features of one or more embodiments of the invention. For example, an object that is "substantially" enclosed would mean that the object is either completely enclosed or nearly completely enclosed. The exact allowable degree of deviation from absolute completeness may in some cases depend on the specific context. However, generally speaking, the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, the term "about" is used to provide flexibility to a numerical range endpoint by providing that a given value may be "a little above" or "a little below" the endpoint.

As used herein, the term "handheld precise liquid marker" generally refers to any disposable or re-usable device, preferably with a liquid delivery mechanism, designed to release a precise amount of fluid, preferably ink, medicinal liquid, or any other liquid, and may be of any shape such as compact or pen-type. The marking of the handheld precise liquid marker may be provided through a mechanical (optionally manual) or stored energy drive mechanism, such as a spring. The marking device may include a separate liquid cartridge to hold ink or any other liquid.

The terms "housing", "main housing", "front housing", and "rear housing" generally refer to an exterior housing (e.g., "body", "shell", "outer body") or interior housing ("inner body", "insert"), which may have internal and external threads. The housing may be designed to enable the safe, correct, and comfortable handling of the handheld precise liquid marker or any of its mechanisms. Usually, the housing is designed to house, fix, protect, guide, and/or engage with any of the inner components of the handheld precise liquid marker (e.g., the projecting-retracting mechanism, liquid cartridge, spring) by limiting the exposure to contaminants, such as liquid, dust, dirt, etc. . . . In general, the housing may be unitary or a multi-part component of tubular or non-tubular shape. Usually, the exterior housing serves to house a reservoir from which fluid may be dispensed. However, the reservoir may be directly coupled to the housing, so as to be partly or fully external to the housing. Further, the housing may include aesthetic and ergonomic features such as a grip with a dimpled surface used to resemble or simulate a golf ball and/or a rubber grommet.

The term "piston" generally refers to a component adapted to operate through/within the housing, designed to transfer movement within the handheld precise liquid marker, for purposes of providing a counter force. The piston may be flexible or rigid. The piston may be a simple rod, spring-loaded system, lead-screw, rack and pinion system, or the like.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

The present invention is preferably a handheld precise liquid marker that is preferably shaped like a pen. The handheld precise liquid marker preferably provides a perfect dot when marking one or more surfaces and is preferably used for multiple applications such as marking a dimple of a golf ball surface and/or providing a proper amount of dosage for medicinal applications. The handheld precise liquid marker also may be combined with a traditional marking pen rather than standard. The handheld precise liquid marker preferably has a reservoir that may contain any liquid, including a dye—such as ink—or a medicinal liquid. The handheld precise liquid marker may be applied to certain surfaces such as a dimple of a golf ball or a person's skin. The liquid is preferably delivered from the reservoir and out through a nib by applying pressure on the nib to a surface. The nib preferably retracts inside the tip of the front housing due to the pressure applied, which typically causes the pressure in the reservoir to rise. The retraction of the nib is generally controlled by contact between the inner flange of a main housing and the shoulder of the front housing. A spring behind the reservoir generally provides the counter force to the nib being pushed inward. Preferably, an audible "click" is heard as the spring is compressed. The "click" generally informs the user that a sufficient amount of pressure has been applied to deliver the desired amount of ink. The nib is preferably designed to deliver the liquid topically, such as to surfaces of a golf ball or a person's skin.

FIG. 1 is an illustration of a cross-sectional, exploded perspective view of one embodiment of the handheld precise liquid marker. As shown in FIG. 1, one embodiment of the handheld precise liquid marker 100 may comprise: a front cap 105, main housing 110, first nib 115, front housing 120, liquid 125, 150, second cylinder 130, spring 135, first cylinder 140, plug 145, rear housing 155, second nib 160, and end cap 165. As discussed above, the housing (i.e., main housing 110, front housing 120, and rear housing 155) is preferably a structure designed to house, fix, protect, guide, and/or engage with any of the inner components of the handheld precise liquid marker 100 by enabling the safe, correct, and comfortable handling of the handheld precise liquid marker 100 or any of its mechanisms. The main housing 110, front housing 105, and rear housing 155 may be a single piece or may be comprised of multiple pieces and may also include other components (e.g., a clip or additional nib). The front cap 105 is preferably a cover that attached to the front end of the handheld precise liquid marker 100 (i.e., main housing 110) and covers the first nib 115 to prevent unwanted contact between the first nib 115 and a surface. The front housing 120 is preferably the structure that contains a reservoir 123 or chamber that holds, contains, and/or restricts the ink or any liquid 125. The front housing 120 preferably comprises a first nib 115, which is in fluid communication with the reservoir 123, and the first nib 115 preferably delivers a flow of ink or liquid 125 from the reservoir 123 to one or more surfaces upon application of pressure to the first nib 115. A portion of the first nib 115 may extend towards the reservoir 123 or may be separated by an intervening piece. The first nib 115 also may be constructed of any material such as porous polymer material (e.g., custom Porex® material), foam rubber, fiber, fiberglass, silicone rubber, fabric, or metal (e.g., gold, palladium silver, steel, brass, titanium, and the like). Furthermore, the first nib 115 may be shaped to have a certain structure to conform to a particular surface, such as a dimple of a golf ball. The one or more surfaces are preferably any external or outermost layer of an object, person, or environment, such that the handheld precise liquid marker 100 may be used for multiple applications, including medicinal applications. The piston is preferably the structure that provides a counterforce to the first nib 115 after the first nib 115 is pushed inward towards the main housing 110 and against the surface. The piston may comprise: a first cylinder 140, second cylinder 130, and spring 135 and may comprise one or more tabs (shown in FIG. 6). A portion of the second cylinder 130 may be configured to hold or secure liquid 125 stored in the reservoir 123 of the front housing 120. A user may also refill the reservoir 123 by removing the second cylinder 130 from the front housing 120 and refilling the front housing 120 with liquid 125. The spring 135 is preferably housed in-between the first cylinder 140 and second cylinder 130 and preferably provides biasing towards the rear end of the front housing 120. Specifically, the front housing 120 is preferably positioned inside the main housing 110, such that, a portion of the first nib 115 protrudes outside the central opening of the main housing 110. The portion of the first nib 115 preferably retracts back through the central opening of the main housing upon compression of the first nib 115 onto a surface, and the first nib 115 preferably projects through the central opening due to the biasing of the piston (i.e., first cylinder 140, second cylinder 130, and spring 135) when the first nib 115 is not pressed onto the surface.

FIG. 1 also shows that the front housing 120 preferably comprises a shoulder 118 and that the main housing 110 preferably comprises an inner flange 108. The shoulder 118 of the front housing 120 is generally designed to restrict the protrusion of the first nib 115 through the central opening of the main housing 110. Specifically, when the piston biases the front housing 120 towards the main housing 110, the shoulder 118 preferably contacts the inner flange 108 of the main housing 110, such that the protrusion of the first nib 115 through the central opening of the main housing 110 is restricted.

Additionally, the retraction of the first nib 115 is preferably controlled. As discussed above, the first nib 115 preferably protrudes at a precise distance due to contact between the shoulder 118 and inner flange 108. This, in-turn, preferably controls the pressure and audible/tactile feedback that ultimately determines the amount of liquid 125 being delivered by the handheld precise liquid marker 100.

Furthermore, FIG. 1 shows that the rear portion of the handheld precise liquid marker 100 may comprise: a plug 145, rear housing 155, second nib 160, and end cap 165. Like the front housing 120, the rear housing 155 is preferably a structure that contains a reservoir 153 or chamber that holds, contains, and/or restricts ink or liquid 150. The rear housing 155 preferably comprises a second nib 160, which is in fluid communication with the reservoir 153, and the second nib 160 preferably delivers a flow of ink or liquid 150 from the reservoir 153 to one or more surfaces upon application of pressure to the second nib 160 to the surface. A portion of the second nib 160 may extend towards the reservoir 153 or may be separated by an intervening piece. Additionally, the second nib 160 may be constructed of any materials such as porous polymer material (e.g., custom Porex® material), foam rubber, fiber, fiberglass, silicone rubber, fabric, or metal (e.g., gold, palladium silver, steel, brass, titanium, and the like). Furthermore, the second nib 160 is preferably shaped with a pointed tip to provide the user with thin strokes for writing on one or more surfaces. The plug 145 is preferably an obstruction for blocking one end of the reservoir 153 to prevent leakage of the liquid 150 from the rear housing 155 and may be configured to hold and/or secure a portion of the piston. The end cap 165 is preferably a cover that attached to the rear end of the handheld precise liquid marker 100 (i.e., rear housing 155) and covers the second nib 160 to prevent unwanted contact between the second nib 160 and a surface.

Finally, regarding the main housing 110, the handheld precise liquid marker 100 may comprise a grip 170 or grommet, which is preferably a part or attachment by which the handheld precise liquid marker 100 may be held in the hand. The grip 170 may be substantially curved with a plurality of dimples and/or may provide an aesthetic look, such that the grip resembles the outer surface of a golf ball.

Figure 2:
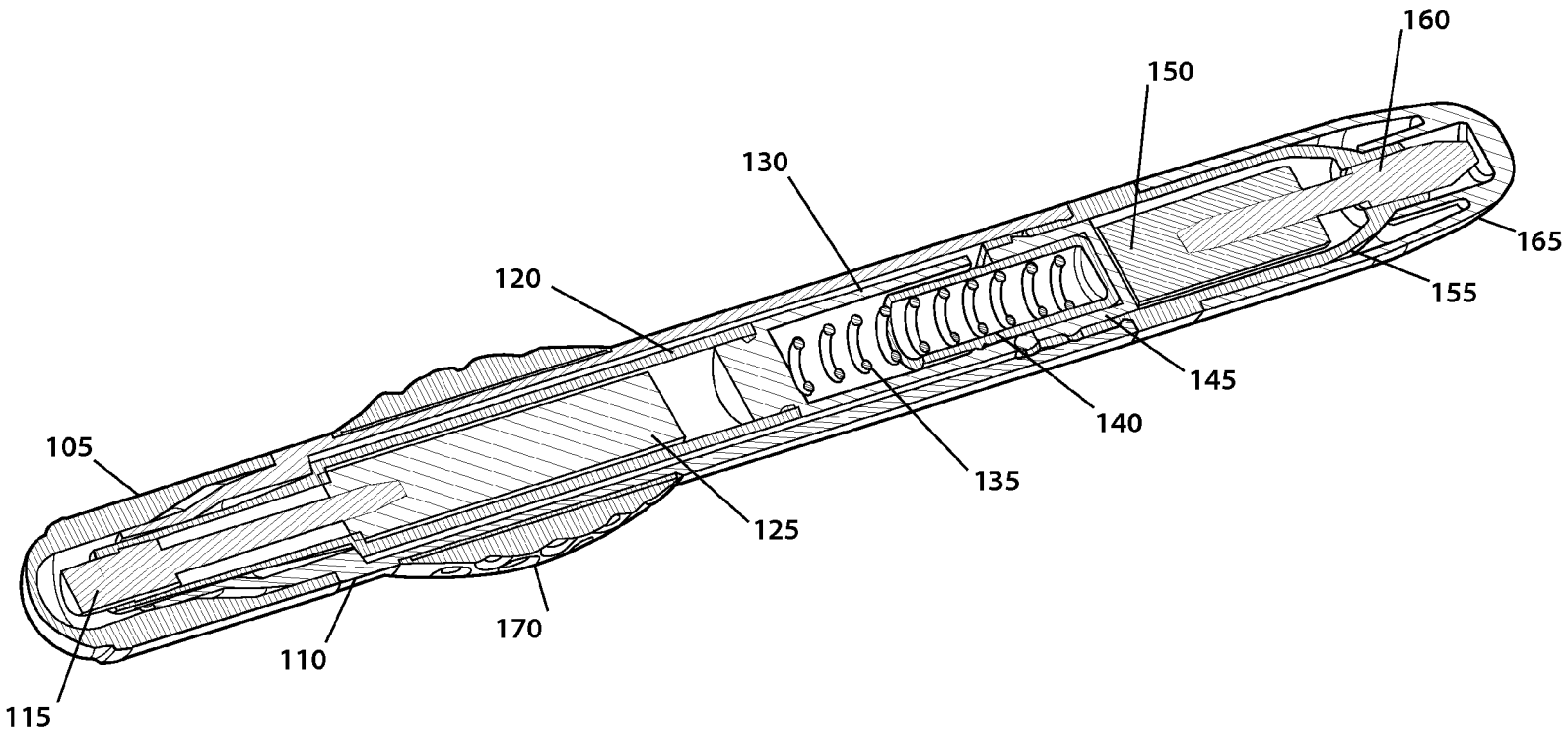
FIG. 2 is an illustration of a cross-sectional, assembled perspective view of one embodiment of the handheld precise liquid marker.

FIG. 2 is an illustration of a cross-sectional, assembled perspective view of one embodiment of the handheld precise liquid marker. As shown in FIG. 2, one embodiment of the handheld precise liquid marker 100 may comprise: a front cap 105, main housing 110, first nib 115, front housing 120, liquid 125, 150, second cylinder 130, spring 135, first cylinder 140, plug 145, rear housing 155, second nib 160, and end cap 165. FIG. 2 shows that liquid 125 may be stored in the reservoir 123 of the front housing 120. Additionally, the first nib 115 is preferably attached to the forward end of the front housing 120. A portion of the first nib 115 is preferably in contact with the liquid 125 stored in the reservoir 123, such that the liquid 125 may flow through front or forward end of the first nib 115. The piston, which may comprise a first cylinder 140, second cylinder 130, and spring 135, is preferably positioned behind the rear end of the front housing 120 and is preferably configured to provide a biasing mechanism for the front housing 120. The main housing 110 is preferably configured to house or enclose the front housing 120, its components (e.g., first nib 115, liquid 125, etc. . . . ), and the piston and generally comprises a front cap 105, which is removeably connected to the forward end of the main housing 110. The main housing 110 may also comprises a grip 170.

Regarding the rear portion of the handheld precise liquid marker 100 (i.e., plug 145, rear housing 155, second nib 160, and end cap 165), the rear portion of the handheld precise liquid marker 100 is preferably configured for writing thin or broad strokes. As shown in FIG. 2, the plug 145 is preferably attached to the front end or forward end of the rear housing 155 to store liquid 150 in the reservoir of the rear housing 155. Specifically, a user may remove the plug 145 and fill the reservoir 153 of the rear housing 155 with ink or liquid 150. The second nib 160 is preferably attached to the rear end of the rear housing 155, and preferably, the end cap 165 is removeably attached to the rear end of the rear housing 155.

Figure 3:
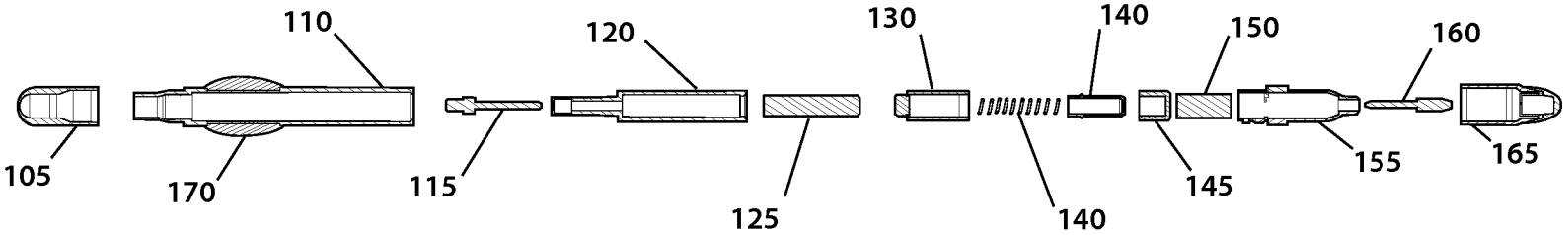
FIG. 3 is an illustration of a cross-sectional, exploded top view of one embodiment of the interior portion of the handheld precise liquid marker.

FIG. 3 is an illustration of a cross-sectional, exploded top view of one embodiment of the interior portion of the handheld precise liquid marker. As shown in FIG. 3, one embodiment of the handheld precise liquid marker invention 100 may comprise: a front cap 105, main housing 110, first nib 115, front housing 120, liquid 125, 150, second cylinder 130, spring 135, first cylinder 140, plug 145, rear housing 155, second nib 160, and end cap 165.

Figure 4:
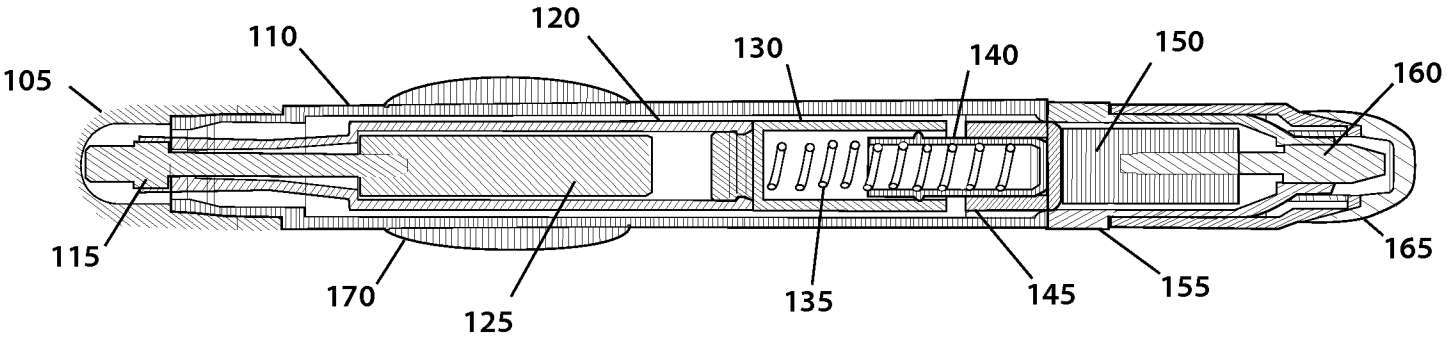
FIG. 4 is an illustration of a cross-sectional, assembled top view of one embodiment of the handheld precise liquid marker.

FIG. 4 is an illustration of a cross-sectional, assembled top view of one embodiment of the handheld precise liquid marker. As shown in FIG. 4, one embodiment of the handheld precise liquid marker 100 may comprise: a front cap 105, main housing 110, first nib 115, front housing 120, liquid 125, 150, second cylinder 130, spring 135, first cylinder 140, plug 145, rear housing 155, second nib 160, and end cap 165.

Figure 5:
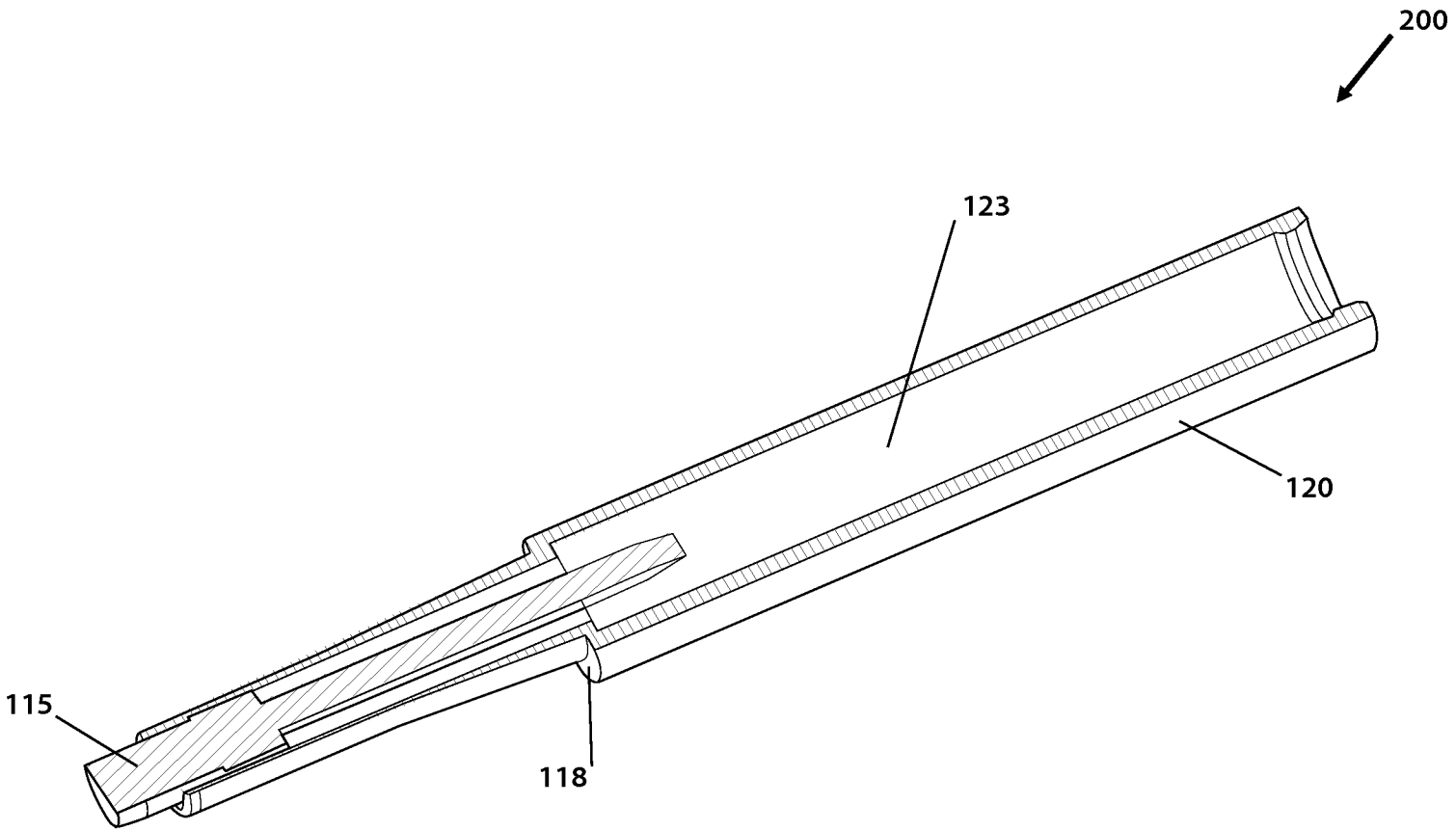
FIG. 5 is an illustration of a cross-sectional, perspective view of one embodiment of the front housing assembly.

FIG. 5 is an illustration of a cross-sectional, perspective view of one embodiment of the front housing assembly. As shown in FIG. 5, one embodiment of the front housing assembly 200 may comprise: a front housing 120 and first nib 115. The front housing 120 may also comprise a reservoir 123 and shoulder 118. Preferably liquid is stored in the reservoir 123 of the front housing 120 and preferably the first nib 115 is attached to the forward end or front portion of the front housing 120. The rear end of first nib 115 also preferably extends towards the reservoir 123 of the front housing 120, such that the first nib 115 may contact the liquid 125 stored in the reservoir 123.

Figure 6:
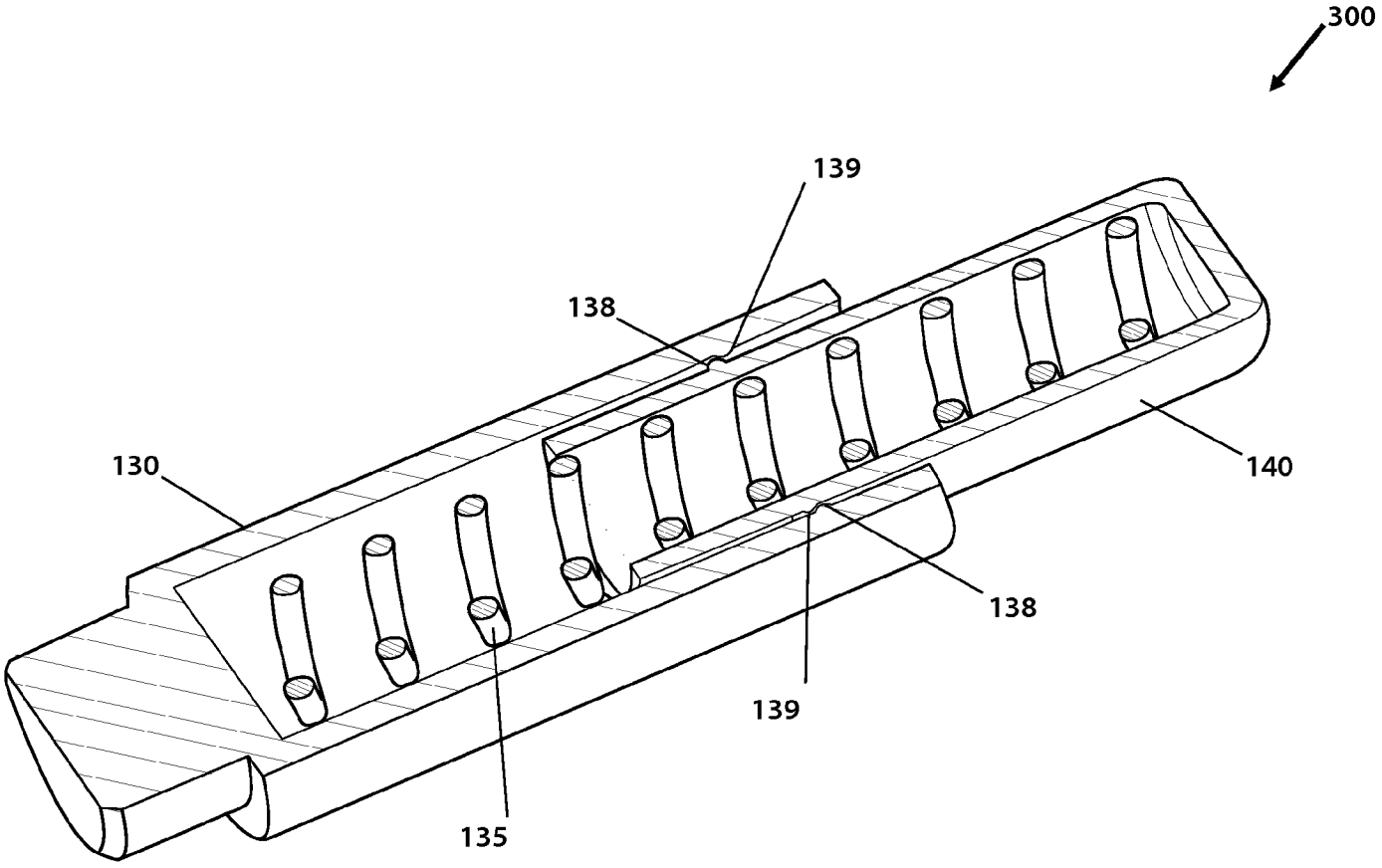
FIG. 6 is an illustration of a cross-sectional, perspective view of one embodiment of the piston.

FIG. 6 is an illustration of a cross-sectional, perspective view of one embodiment of the piston. As shown in FIG. 6, one embodiment of the piston 300 may comprise: a first cylinder 140, second cylinder 130, spring 135, first tabs 138, and second tabs 139. The spring 135 is preferably located in-between and within the first cylinder 140 and second cylinder 130 and preferably provides a biasing mechanism for the piston 300. The first tabs 138 are preferably located on the outer surface or exterior of the first cylinder 140, and the second tabs 139 are preferably located on the inner surface or interior of the second cylinder 130. The first tabs 138 and second tabs 139 are preferably configured to contact each other when first nib 115 and front housing 120 press against the piston 300 (i.e., the second cylinder 130 compressing the spring 135 against the first cylinder 140) and preferably create an audible sound upon contact with each other. Thus, an audible click may be heard when the spring 135 is compressed. Specifically, the first tabs 138 and second tabs 139 may create an audible click due to any interfering plastic that rides against the spring 135. Contact between the first tabs 138 and second tabs 139 may also preferably create a tactile response when the user presses the first nib 115 against a surface.

Figure 7:
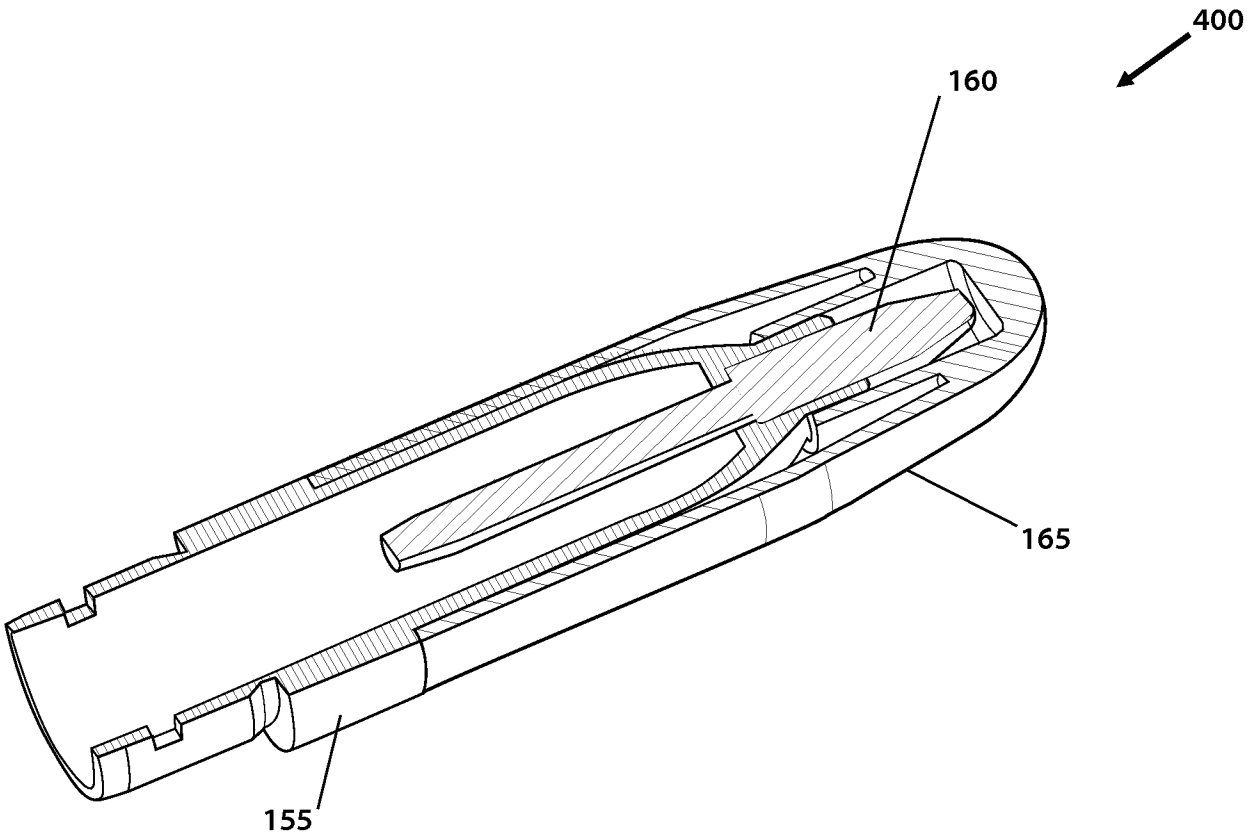
FIG. 7 is an illustration of a cross-sectional, perspective view of one embodiment of the rear housing assembly.

FIG. 7 is an illustration of a cross-sectional, perspective view of one embodiment of the rear housing assembly. As shown in FIG. 7, one embodiment of the rear housing assembly 400 may comprise: a rear housing 155, second nib 160, and end cap 165. FIG. 7 shows that the second nib 160 is preferably attached to the rear end of the rear housing 155. Additionally, the end cap 165 is preferably attached to the rear end of the rear housing 155 and preferably covers the rear end of the second nib 160.

Figure 8:
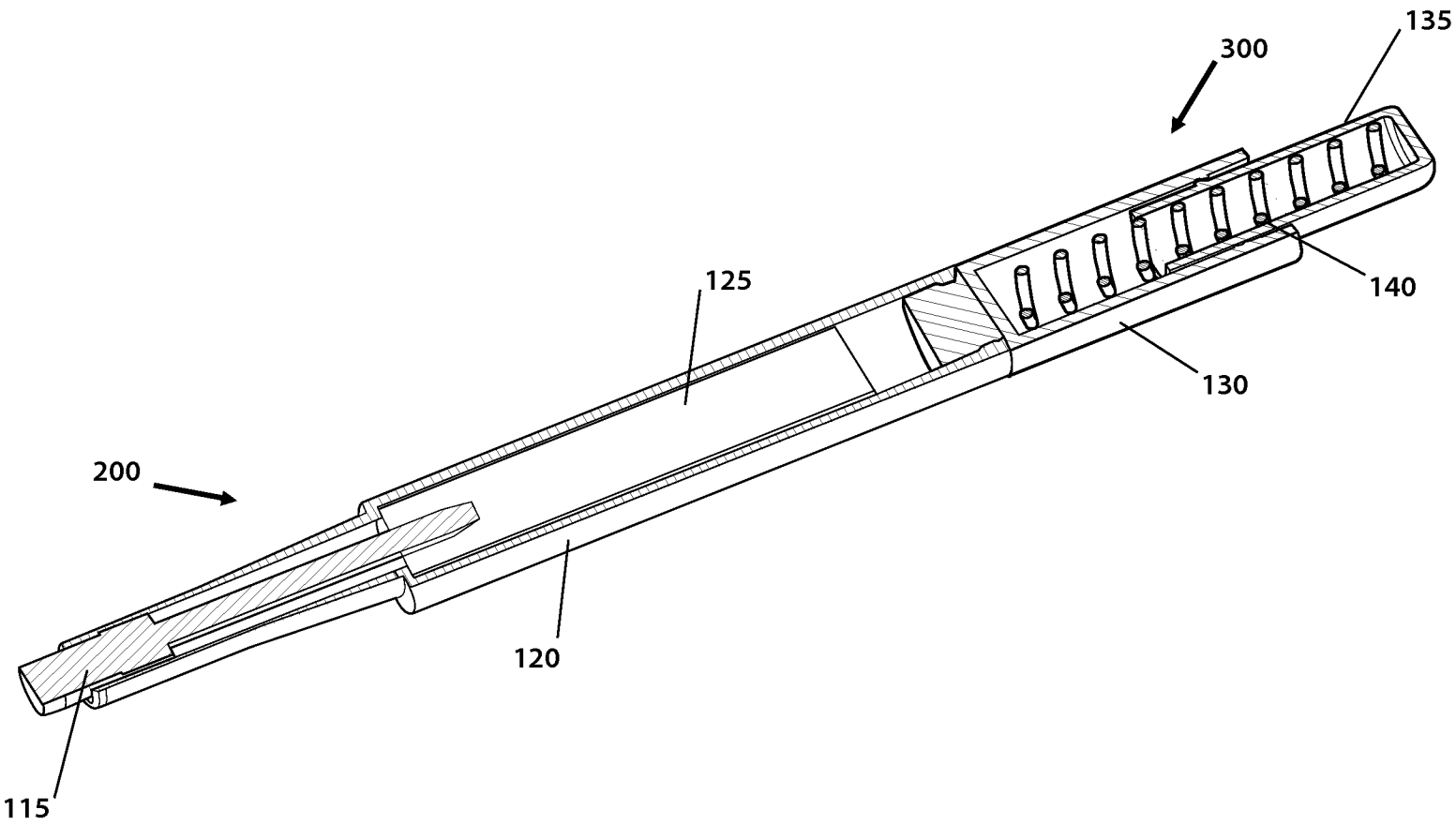
FIG. 8 is an illustration of a cross-sectional, perspective view of one embodiment of the front housing assembly and shows how the front housing assembly is filled with liquid.

FIG. 8 is an illustration of a cross-sectional, perspective view of one embodiment of the front housing assembly and shows how the front housing assembly is filled with liquid. As shown in FIG. 8, both the front housing assembly 200 and the piston 300 may comprise: a first nib 115, front housing 120, liquid 125, second cylinder 130, first cylinder 140, and spring 135. The first nib 115 is preferably attached to the front end or front portion of the front housing 120. A portion of the second cylinder 130 of the piston 300 removeably attaches to the rear portion or rear end of the front housing 120, such that the second cylinder 130 may function as a plug to store liquid 125 in the reservoir 123 of the front housing 120. Thus, a liquid 125 may be stored in the reservoir 123 of the front housing 120 and may travel through the first nib 115 when pressure by a surface is applied against the first nib 115. The spring 135 preferably provides the biasing or counter force to project the front housing assembly 120 through the main housing 110.

Figure 9:
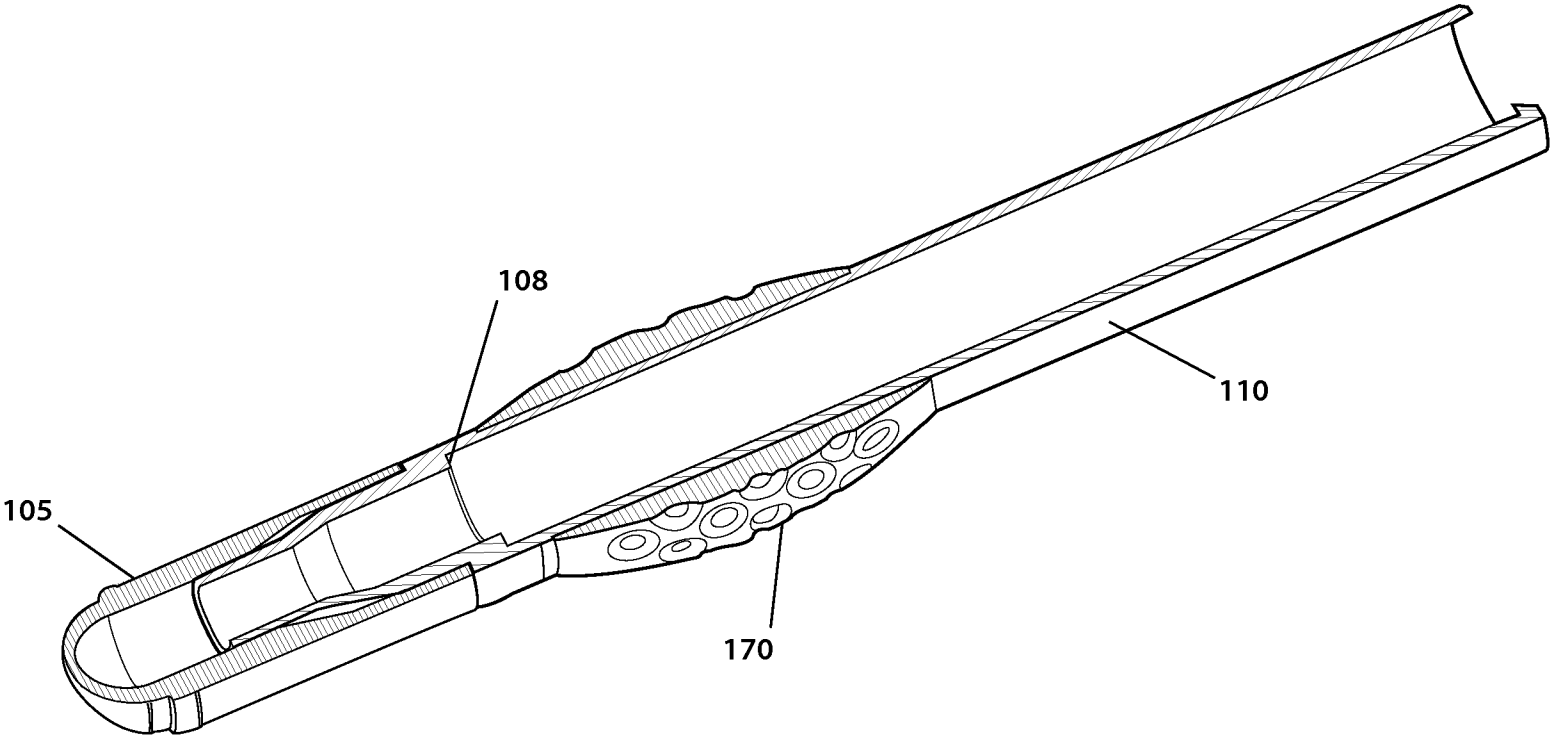
FIG. 9 is an illustration of a cross-sectional, perspective view of one embodiment of the main housing and front cap and shows how the front cap may be attached to the main housing.

FIG. 9 is an illustration of a cross-sectional, perspective view of one embodiment of the main housing and front cap and shows how the front cap may be attached to the main housing. As shown in FIG. 9, the main housing 110 may comprise: a grip 170 and an inner flange 108. FIG. 9 shows that the front cap 105 may removeably attach to the forward end or front portion of the main housing 110.

Figure 10:
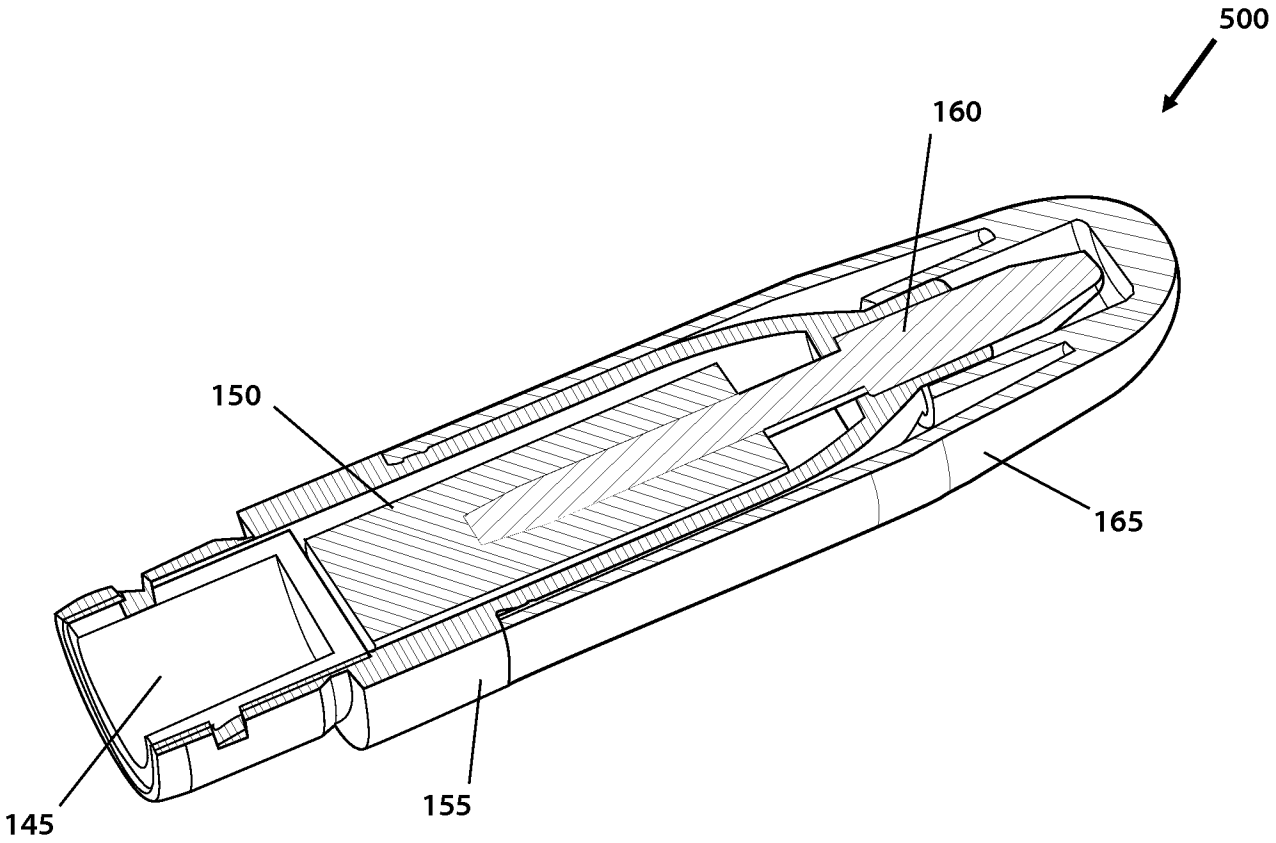
FIG. 10 is an illustration of a cross-sectional, perspective view of another embodiment of the rear housing assembly and shows how the rear housing assembly is filled with liquid.

FIG. 10 is an illustration of a cross-sectional, perspective view of another embodiment of the rear housing assembly and shows how the rear housing assembly is filled with liquid. As shown in FIG. 10, the rear housing assembly 500 may comprise: a plug 145, liquid 150, rear housing 155, second nib 160, and end cap 165. Preferably, the plug 145 is removeably connected to the forward end or front portion of the rear housing 155. The second nib 160 is preferably attached to the rear portion or rear end of the rear housing 155. Liquid 150 is typically filled through the front portion of the rear housing 155 when the plug 145 is removed and is preferably stored in the reservoir of the rear housing 155 after plug is installed 145. The end cap 165 is preferably removeably attached to the rear portion or rear end of the rear housing assembly 500.

Figure 11:
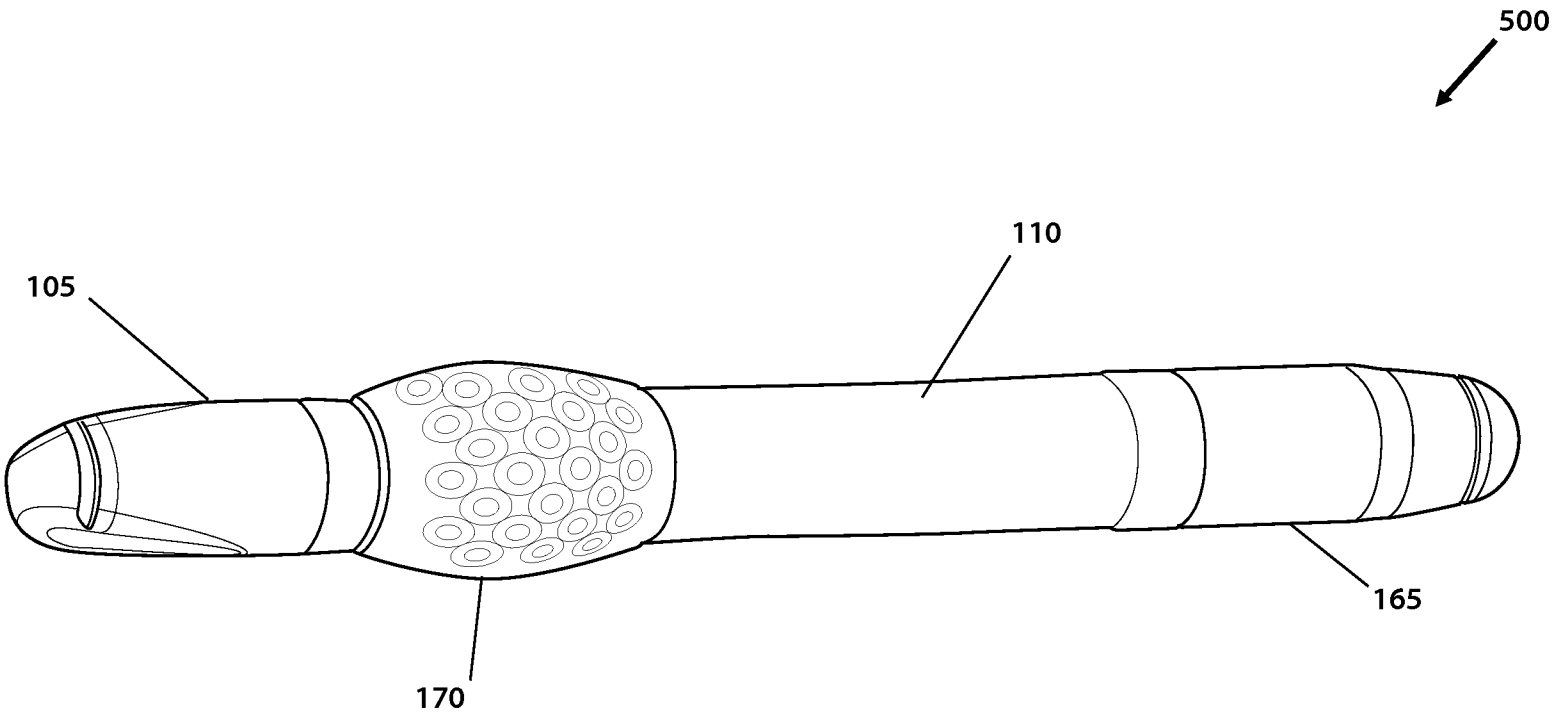
FIG. 11 is an illustration of a perspective view of another embodiment of the handheld precise liquid marker.

FIG. 11 is an illustration of a perspective view of another embodiment of the handheld precise liquid marker. As shown in FIG. 11, another embodiment of the handheld precise liquid marker 600 may comprise: a front cap 105, main housing 110, rear housing 155, and end cap 165. Preferably, the front cap 105 is removeably connected to the forward end or front portion of the main housing 110. Preferably, the rear housing 155 is removeably connected to the rear portion of the main housing 110. The end cap 165 is preferably removeably connected to the rear end or rear portion of the rear housing 110.

FIG. 11 also shows that the main housing 110 may comprise a grip 170. The grip 170 may be shaped with aesthetic features. For example, the grip 170 may contain a plurality of dimples, such that the grip 170 may resemble the surface of a golf ball.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A handheld precise liquid marker comprising,
a front housing;
a first nib;
a piston; and
a spring;
wherein said front housing comprises a first reservoir;
wherein said first reservoir is configured to store a liquid;
wherein said front housing has a forward end and a rear end;
wherein said first nib is positioned at said forward end of said front housing and is in fluid communication with said first reservoir;
wherein said piston is positioned behind said rear end of said front housing;
wherein said spring is positioned inside said piston, such that said piston biases towards said rear end of said front housing;
wherein said piston comprises: a first cylinder, a second cylinder, one or more first tabs, and one or more second tabs;
wherein said one or more first tabs are located at an outer surface of said first cylinder;
wherein said one or more second tabs are located at an inner surface of said second cylinder;
wherein said spring is positioned in-between said first cylinder and said second cylinder, such that a portion of said second cylinder overlaps a portion of said first cylinder; and
wherein said one or more first tabs and one or more second tabs produces an audible click upon said compression of said first nib, such that said compression of said first nib causes said one or more first tabs to contact said one or more second tabs.

2. The handheld precise liquid marker of claim 1, wherein said one or more first tabs and one or more second tabs produces a tactile response upon said compression of said first nib.

3. A handheld precise liquid marker, comprising:
a front housing;
a first nib;
a piston;
a spring;
a rear housing; and
a second nib;
wherein said front housing comprises a first reservoir;
wherein said first reservoir is configured to store a liquid;
wherein said front housing has a forward end and a rear end;
wherein said first nib is positioned at said forward end of said front housing and is in fluid communication with said first reservoir;
wherein said piston is positioned behind said rear end of said front housing;
wherein said spring is positioned inside said piston, such that said piston biases towards said rear end of said front housing;
wherein said rear housing comprises a second reservoir;

wherein said second reservoir is configured to store said liquid;

wherein said second reservoir has a forward end and a rear end;

wherein said second nib is positioned at said rear end of said second reservoir and is in fluid communication with said second reservoir;

wherein said plug removeably attaches to said forward end of said rear housing; and wherein said piston is configured to removeably attach to said plug.

4. A handheld precise liquid marker, comprising:

a front housing;

a first nib;

a piston;

a spring; and a main housing;

wherein said front housing comprises a first reservoir;

wherein said first reservoir is configured to store a liquid;

wherein said front housing has a forward end and a rear end;

wherein said first nib is positioned at said forward end of said front housing and is in fluid communication with said first reservoir;

wherein said piston is positioned behind said rear end of said front housing;

wherein said spring is positioned inside said piston, such that said piston biases towards said rear end of said front housing;

wherein said main housing has a central opening;

wherein said front housing is substantially enclosed within said main housing, such that, a portion of said first nib protrudes through said central opening of said main housing, and, such that a portion of said first nib controllably retracts through said central opening of said main housing upon compression of said first nib onto one or more surfaces; and wherein said first nib is substantially curved, such that said first nib is configured to matingly engage with a single dimple of a golf ball, and when said first nib contacts said dimple of said golf ball, a substantially round ink dot is created on said dimple of said golf ball;

wherein said piston comprises: a first cylinder, a second cylinder, one or more first tabs, and one or more second tabs;

wherein said one or more first tabs are located at an outer surface of said first cylinder;

wherein said one or more second tabs are located at an inner surface of said second cylinder;

wherein said spring is positioned in-between said first cylinder and said second cylinder, such that a portion of said second cylinder overlaps a portion of said first cylinder; and wherein said one or more first tabs and one or more second tabs produces an audible click upon said compression of said first nib, such that said compression of said first nib causes said one or more first tabs to contact said one or more second tabs.

5. The handheld precise liquid marker of claim 4, wherein said front housing further comprises a shoulder;

wherein said shoulder of said front housing is located at an exterior of said front housing;

wherein said main housing comprises an inner flange located inside an interior of said main housing; and wherein said shoulder is configured to restrict said projection of said portion of said nib through said central opening of said main housing when said shoulder of said front housing contacts said inner flange of said main housing.

6. The handheld precise liquid marker of claim 5, wherein said one or more first tabs and one or more second tabs produces a tactile response upon said compression of said first nib.

7. The handheld precise liquid marker of claim 6, further comprising:

a rear housing; and a second nib;

wherein said rear housing comprises a second reservoir;

wherein said second reservoir is configured to store said liquid;

wherein said second reservoir has a forward end and a rear end; and wherein said second nib is positioned at said rear end of said second reservoir and is in fluid communication with said second reservoir.

8. The handheld precise liquid marker of claim 7, further comprising a plug;

wherein said plug removeably attaches to said forward end of said rear housing; and wherein said piston is configured to removeably attach to said plug.

9. The handheld precise liquid marker of claim 8, wherein said second nib has a substantially sharp point, such that said second nib is configured to create one or more thin strokes on said one or more surfaces when said second nib is applied to said one or more surfaces.

10. The handheld precise liquid marker of claim 9, wherein said main housing comprises a grip; and wherein said grip is substantially curved and comprises a plurality of dimples, such that said grip resembles a surface of said golf ball.

11. The handheld precise liquid marker of claim 10, wherein said first nib is constructed of a porous polymer material.

12. The handheld precise liquid marker of claim 11, wherein said second nib is constructed of a porous polymer material.

13. A handheld precise liquid marker, comprising:

a front housing;

a first nib;

a piston;

a spring;

a main housing;

a rear housing;

a second nib; and a plug;

wherein said front housing comprises a first reservoir;

wherein said first reservoir is configured to store a liquid;

wherein said front housing has a forward end and a rear end;

wherein said first nib is positioned at said forward end of said front housing and is in fluid communication with said first reservoir;

wherein said piston is positioned behind said rear end of said front housing;

wherein said spring is positioned inside said piston, such that said piston biases towards said rear end of said front housing;

wherein said main housing comprises a central opening;

wherein said front housing is substantially enclosed within said main housing, such that, a portion of said first nib protrudes through said central opening of said main housing, and, such that a portion of said first nib controllably retracts through said central opening of said main housing upon compression of said first nib onto one or more surfaces;

wherein said front housing further comprises a shoulder;

wherein said shoulder of said front housing is located at an exterior of said front housing;

wherein said main housing comprises an inner flange located inside an interior of said main housing;

wherein said shoulder is configured to restrict said projection of said portion of said nib through said central opening of said main housing when said shoulder of said front housing contacts said inner flange of said main housing;

wherein said piston comprises: a first cylinder, a second cylinder, one or more first tabs, and one or more second tabs;

wherein said one or more first tabs are located at an outer surface of said first cylinder;

wherein said one or more second tabs are located at an inner surface of said second cylinder;

wherein said spring is positioned in-between said first cylinder and said second cylinder, such that a portion of said second cylinder overlaps a portion of said first cylinder;

wherein said one or more first tabs and one or more second tabs produces an audible click upon said compression of said first nib, such that said compression of said first nib causes said one or more first tabs to contact said one or more second tabs;

wherein said one or more first tabs and one or more second tabs produces a tactile response upon said compression of said first nib;

wherein said rear housing comprises a second reservoir;

wherein said second reservoir is configured to store said liquid;

wherein said second reservoir has a forward end and a rear end;

wherein said second nib is positioned at said rear end of said second reservoir and is in fluid communication with said second reservoir;

wherein said plug removeably attaches to said forward end of said rear housing;

wherein said piston is configured to removeably attach to said plug;

wherein said second nib has a substantially sharp point, such that said second nib is configured to create one or more thin strokes on said one or more surfaces when said second nib is applied to said one or more surfaces; and wherein said first nib is constructed of a porous polymer material.

* * * * *